US009730291B1

(12) United States Patent
Janik et al.

(10) Patent No.: US 9,730,291 B1
(45) Date of Patent: Aug. 8, 2017

(54) COLOR TEMPERATURE ADJUSTMENT BASED ON DIM LEVEL

(71) Applicants: Raymond George Janik, Fayetteville, GA (US); Russell Scott Trask, Sharpsburg, GA (US)

(72) Inventors: Raymond George Janik, Fayetteville, GA (US); Russell Scott Trask, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/288,844

(22) Filed: Oct. 7, 2016

(51) Int. Cl.
*H05B 33/08* (2006.01)

(52) U.S. Cl.
CPC ..... *H05B 33/0857* (2013.01); *H05B 33/0827* (2013.01); *H05B 33/0845* (2013.01)

(58) Field of Classification Search
CPC H05B 33/08; H05B 33/0809; H05B 33/0827; H05B 33/0845; H05B 33/0857; H05B 33/083; H05B 33/089; H05B 37/02
USPC ..... 315/185 R, 192, 196, 209 R, 224–226, 315/291, 297, 307, 308, 312
See application file for complete search history.

(56) References Cited

U.S. PATENT DOCUMENTS 8,710,754 B2 * 4/2014 Baddela ..... H05B 33/086 315/192
8,896,227 B2 * 11/2014 Moskowitz ..... H05B 33/0809 315/209 R

* cited by examiner

*Primary Examiner* — Jimmy Vu
(74) *Attorney, Agent, or Firm* — King & Spalding LLP

(57) ABSTRACT

A lighting device includes a light source that emits an illumination light. The light source includes a first group of light emitting diodes (LEDs) that emits a first light and a second group of LEDs that emits a second light. The first light has a first Correlated Color Temperature (CCT), and the second light causes the illumination light to have a warmer CCT. The lighting device further includes a differential amplifier to adjust a current flow through the second group of LEDs. The second light is switched on when a current provided to the light source is below a threshold corresponding to the adjustable reference voltage. The lighting device also includes a current sensor to provide a sensor output signal to a second input of the differential amplifier, the sensor output signal having a second voltage corresponding to the current provided to the light source.

20 Claims, 4 Drawing Sheets

COLOR TEMPERATURE ADJUSTMENT BASED ON DIM LEVEL

TECHNICAL FIELD

The present disclosure relates generally to lighting solutions, and more particularly to LED lighting with color temperature adjustment based on light dim level adjustment.

BACKGROUND

When an incandescent lamp is dimmed, the color temperature drops turning the emitted light warmer with an increased reddish content. In contrast, white LED light sources have a fixed Correlated Color Temperature (CCT), such as 2700 K or 3000 K, which, when dimmed, do not change the CCT. Because a CCT of a light emitted by a lighting device is a combination of the lights emitted by different light sources of the lighting device, some LED lighting devices rely on multiple strings of LEDs, where some the strings of LEDs emit a cool light (e.g., 400 K or 5000 K) while the other one or more strings of LEDS emit a colored light or a warmer white light to make the combined light warmer (e.g. 2700 K or 3000 K). For example, an LED lighting device may include RED and Amber LEDs to shift the CCT of the light emitted by the lighting device along the Black Body Curve (BBC) in the direction of lower CCT. As another example, some LED lighting devices include an additional string of LEDs that emit a white light on the black body curve with a very low CCT that mimics a light from a dimmed incandescent lamp (e.g., 2000 K to 1600 K).

Some lighting devices rely on processor-based Pulse Width Modulation (PWM) circuitry to control current distribution among different strings of LEDs (e.g., a string that emits a cool light (e.g., 3000 K) and a string that emits a warm light (e.g., 1800 K)). However, achieving a desired precision in steering current among the strings of LEDs may be challenging, particularly at lower current levels when dimming is at max. Further, when the current provided by the driver is reduced for high dim levels, the processor may end up consuming a relatively large enough portion of the reduced current such that the light is prematurely turned off. Thus, a solution that enables CCT adjustment in correlation with dim level changes with high precision is desirable.

SUMMARY

The present disclosure relates generally to lighting solutions, and more particularly to LED lighting with color temperature adjustment based on light dim level adjustment. In an example embodiment, a lighting device includes a light source that emits an illumination light. The light source includes a first group of light emitting diodes (LEDs) that emits a first light and a second group of LEDs that emits a second light. The first light has a first Correlated Color Temperature (CCT), and the second light causes the illumination light to have a warmer CCT. The lighting device further includes a differential amplifier (more specifically an Instrumentation Amplifier) to steer the current flow from the first group of LEDs to the second group of LEDs. The lighting device includes a current sensor to provide a sensor output signal to a first input of the differential amplifier, the sensor output signal having a first voltage corresponding to the current provided to the light source.

A reference signal having an adjustable voltage is provided to a second input of the differential amplifier, and the second light is switched on when the driver output current provided to the light source is below a threshold corresponding to the adjustable reference voltage.

In another example embodiment, a lighting fixture includes a light source that emits an illumination light, where the light source includes a first group of light emitting diodes (LEDs) that emits a first light and a second group of LEDs that emits a second light. The first light has a first Correlated Color Temperature (CCT), and the second light has a very low CCT, between 2500 K and 1000 K, causes the illumination light to have a warmer CCT. The lighting fixture further includes a differential amplifier to adjust a current flow through the second group of LEDs. A reference signal having an adjustable voltage is provided to a first input of the differential amplifier. The second light is switched on when the driver output current provided to the light source is below a threshold corresponding to the adjustable reference voltage. The lighting fixture further includes a current sensor to provide a sensor output signal to a second input of the differential amplifier, where the sensor output signal has a second voltage corresponding to the current provided to the light source. The lighting fixture also includes an LED driver that provides the current to the light source, where the LED driver adjusts the current based on light dim level input.

In another example embodiment, a lighting system includes a lighting device that includes a light source that emits an illumination light. The light source includes a first group of light emitting diodes (LEDs) that emits a first light and a second group of LEDs that emits a second light. The first light has a first Correlated Color Temperature (CCT), and the second light causes the illumination light to have a warmer CCT. The lighting device further includes a differential amplifier to adjust a current flow through the second group of LEDs. A reference signal having an adjustable voltage is provided to a first input of the differential amplifier, and the second light is switched on when the driver output current provided to the light source is below a threshold corresponding to the adjustable reference voltage. The lighting device also includes a current sensor to provide a sensor output signal to a second input of the differential amplifier, the sensor output signal having a second voltage corresponding to the driver output current provided to the light source. The lighting system further includes an LED driver that provides the current to the light source, and a dimmer communicably coupled to the LED driver, where the LED driver adjusts the current provided to the light source based on a light dim level input from the dimmer.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
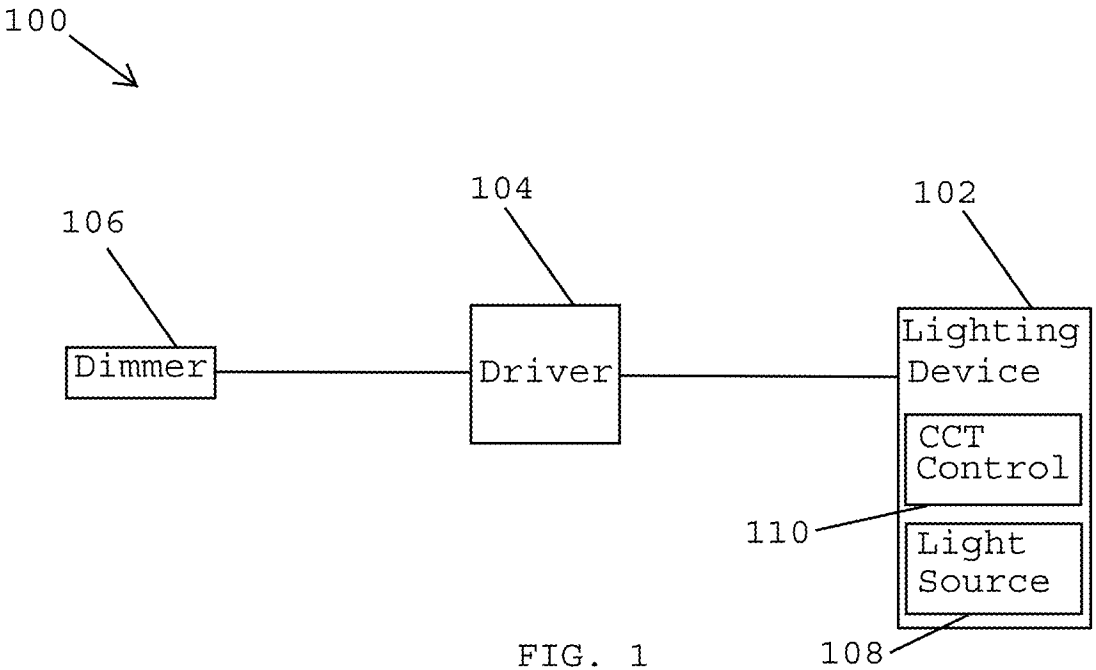
FIG. 1 illustrates a lighting system including a lighting device with multiple groups of LEDs according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

A lighting device that includes a differential amplifier (e.g., an instrumentation amplifier) may be used to control operations of a transistor (e.g., a MOSFET) to steer current provided by an LED driver between a first string of LEDs and a second string of LEDs. The first string of LEDs may emit a light that has a CCT desirable when the light from the lighting device has a high brightness level (i.e., relatively high current from the LED driver). The second string of LEDs may emit a light that has a low CCT desirable when the light from the lighting device is dimmed to have a low brightness level (i.e., relatively low current from the LED driver). The first string of LEDs must have an overall forward voltage that is higher than the second string of LEDs, and the transistor may be coupled in series with the second string of LEDs. When the transistor is in a fully on state, all of the current from the LED driver will be steered through the second string of LEDs because of the lower overall forward voltage of the second string of LEDs.

A differential amplifier may control the transistor based on an adjustable reference voltage and another voltage (e.g., provided by a current sensor) corresponding to the amount of current provided by the LED driver. As the current from the LED driver is reduced to below a threshold level, the differential amplifier starts turning on the transistor until it is fully on. By adjusting the reference voltage provided to the differential amplifier (e.g., using a potentiometer), the differential amplifier may start turning on the transistor at lower or higher threshold level of the current provided to the strings of LEDs. Such a reference voltage adjustment enables changing of the brightness level at which the light from the lighting device starts to turn warmer. The lighting device with such a threshold adjustment capability can eliminate the effect of variance in flux among different LEDs and the effect of variance in driver output current among different drivers by allowing control over the introduction of a warmer CCT light into the overall light provided by a light fixture. It also gives the user the option of setting a threshold of when the CCT starts dropping in value as the dimming in increased and the light output reduced.

Turning now to the drawings, particular embodiments are described. FIG. 1 illustrates a lighting system 100 including a lighting device 102 with multiple groups of LEDs according to an example embodiment. The lighting system 100 includes the lighting device 102, an LED driver 104, and a dimmer 106. The LED driver 104 may be a current source driver that provides a current to the lighting device 102. The amount of current that the LED driver 104 provides to the lighting device 102 may be adjusted by adjusting the setting of the dimmer 106.

The dimmer 106 is communicably coupled to the driver 104 to control the brightness level of an illumination light provided by the lighting device 102. For example, the dimmer 106 may be wired to the driver 104. Alternatively or in addition, the dimmer 106 may wirelessly communicate with the driver 104. A user may control the brightness level of the illumination light from the lighting device 102 by adjusting the setting of the dimmer 106, which accordingly adjusts the amount of current provided to the lighting device 102 by the LED driver 104. For example, a user may slide up and down or rotate a knob of the dimmer 106 to change the brightness level of the illumination light.

The lighting device 102 may include an LED light source 108 and CCT control circuitry 110. The LED light source 108 may include a first group of LEDs that emits a first light and a second group of LEDs that emits a second light. The first light and the second light combine to provide the illumination light of the lighting device 102. The first light may have a CCT that is desirable when the illumination light has a relatively high brightness level (i.e., the dimmer 106 is set such that the illumination light from the lighting device 102 is relatively bright). The second light may have a lower CCT that is desirable when the illumination light has a relatively low brightness level (i.e., the dimmer 106 is set such that the illumination light from the lighting device 102 is relatively dim).

The CCT control circuitry 110 controls the brightness level (i.e., brightness threshold) at which the illumination light from the lighting device 102 starts to turn warmer during adjustment of the dimmer 106 to reduce the brightness level of the illumination light. The CCT control circuitry 110 controls the introduction of the second light (i.e., warmer white light) from the second group of LEDs of the light source 108 to control the brightness level at which the illumination light from the lighting device 102 starts to turn warmer. To illustrate, because the brightness level of the illumination light is dependent on the setting of the dimmer 106 that controls the amount of current provided to the light source 108 by the driver 104, the CCT control circuitry 110 can rely on the amount of current provided to the light source 108 to control the introduction of the second light in order to make the illumination light warmer. The CCT control circuitry 110 can rely on the amount of current provided to the light source 108 to control when the second light is turned off during adjustment of the dimmer 106 to increase the brightness level of the illumination light.

The CCT control circuitry 110 may include a differential amplifier such as an instrumentation amplifier that controls current flow through the light source 108 based on the amount of current provided to the light source 108 and based on a reference signal. The reference signal may have a reference voltage that corresponds to a threshold brightness level at which the second light (i.e., the warmer white light) is introduced in order to make the illumination light from the light source 108 warmer. The reference voltage may be set such that the warmer light from the second light source is introduced to turn the illumination light warmer at a desired brightness level of the illumination light. In some example embodiments, the reference signal may have an adjustable reference voltage that correspondingly changes the threshold brightness level at which the second light is introduced. For example, the level of the adjustable reference voltage may be adjustable by a consumer or by an electrician during or after installation of a lighting fixture that includes the lighting device 102.

By using an analog component such as an instrumentation amplifier, the CCT control circuitry may provide a low cost, high precision solution for controlling the CCT of the illumination light in correlation with the brightness level of the illumination light.

In some alternative embodiments, the LED driver 104 may be a voltage source driver without departing from the scope of this disclosure. In some example embodiments, a lighting fixture may include the lighting device 102 and the driver 104.

Figure 2:
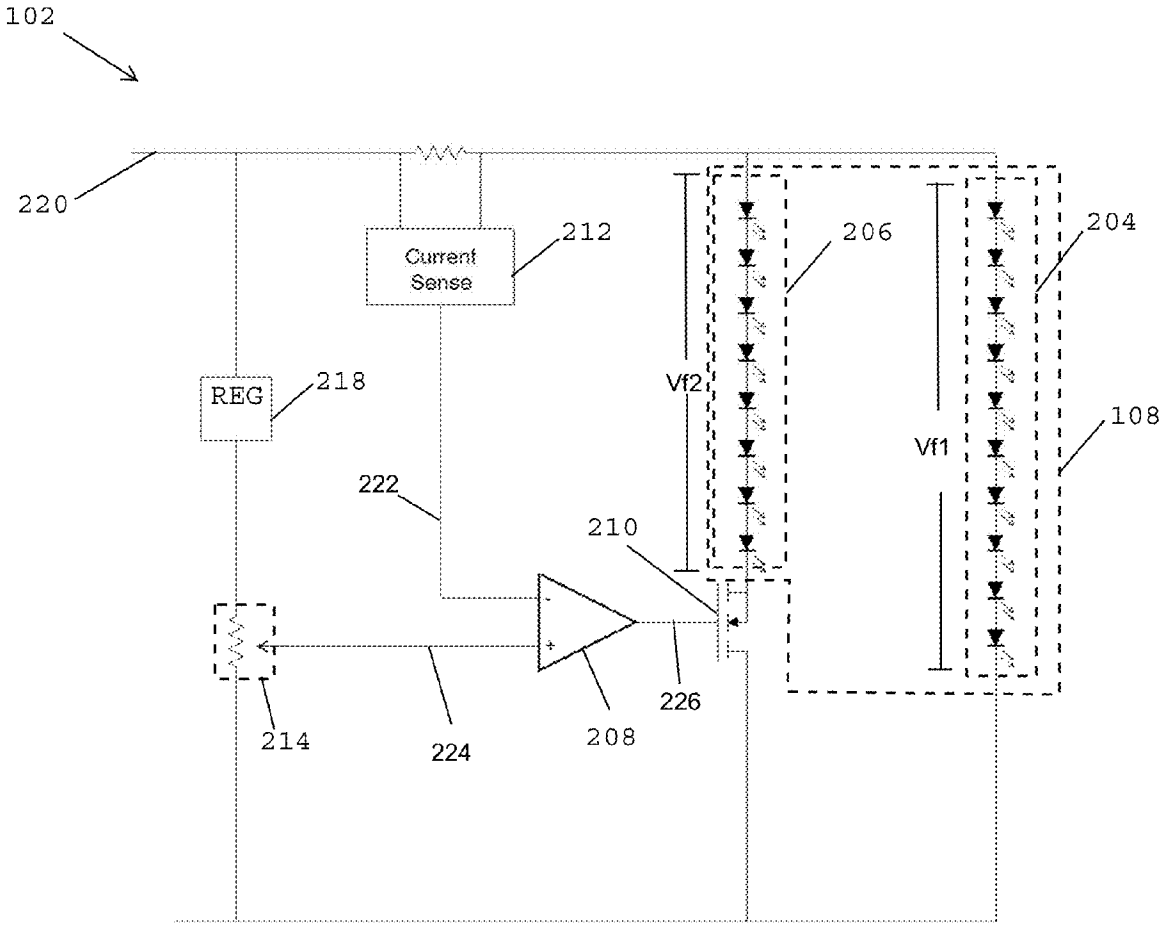
FIG. 2 illustrates the lighting device of FIG. 1 according to an example embodiment.

FIG. 2 illustrates the lighting device of FIG. 1 according to an example embodiment. Referring to FIGS. 1 and 2, the light source 108 includes a first group of LEDs 204 and a second group of LEDs 206. Each group of LEDs 204, 206 may include discrete LEDs, organic light-emitting diodes (OLEDs), an LED chip on board that includes discrete LEDs, an array of discrete LEDs, or a combination thereof. Each group of LEDs 204, 206 may include multiple strings of LEDs that are configured in parallel without departing from the scope of this disclosure. In some example embodiments, the groups of LEDs 204, 206 may include phosphor-converted LEDs.

In some example embodiments, the light source 108 may emit an illumination light that is a combination of a first white light emitted by the first group of LEDs 204 and a second white light emitted by the second group of LEDs 206. The first light emitted by the first group of LEDs 204 may have a CCT desirable when the illumination light is relatively bright. The second light emitted by the second group of LEDs 206 may have a CCT desirable when the illumination light is relatively dim. For example, the first light may have a CCT of 3000 K, and the second light may have a CCT of 1800 K or less.

The first group of LEDs 204 have an overall forward voltage, Vf1, across the first group of LEDs 204 to start emitting the first light. The second group of LEDs 206 have an overall forward voltage, Vf2, across the second group of LEDs 206 to start emitting the second light. The forward voltage, Vf2, across the second group of LEDs 206 must be less than the forward voltage, Vf1, across the first group of LEDs 204 by a voltage amount equivalent to a forward voltage across one or more LEDs. For example, the first group of LEDs 204 may include one or more additional LEDs than the second group of LEDs 206 as illustrated in FIG. 2.

In some example embodiments, the lighting device 102 includes a transistor 210 (e.g., a MOSFET) that is coupled in series with the second group of LEDs 206. The lighting device 100 can also include a differential amplifier 208. For example, the differential amplifier 208 may be a zero offset, rail-to-rail differential amplifier. To illustrate, the differential amplifier 208 may be an instrumentation amplifier. The output of the differential amplifier 208 is coupled to the gate terminal of the transistor 210. The differential amplifier 214 can adjust current flow through the second group of LEDs 206 by controlling the resistance (thus, the transconductance) of the transistor 210. Because a current from the driver 104 is provided to the first group of LEDs 204 and the second group of LEDs 206 via an input connection 220 that is coupled to both groups of LEDs 204, 206, changing the amount of current flowing through the second group of LEDs 206 will change the amount of current flowing through the first group of LEDs 204. When the transistor 210 is fully on, the first group of LEDs 204 is turned off because of the lower overall forward voltage, Vf2, of the second group of LEDs 206 as compared to the overall forward voltage, Vf1.

In some example embodiments, the lighting device 102 includes a current sensor 212 that is electrically coupled to the LED driver 104 via the input connection 220. For example, the current sensor 212 may be a high side current sensor. The current sensor 212 is designed to generate a sensor output signal having a voltage that correlates to the amount of the current provided to the light source 108. The sensor output signal is provided to the differential amplifier 208 via an electrical connection 222. As described above, the amount of the current provided to the light source 108 may change based on a change in setting of the dimmer 106, and the voltage of the sensor output signal may change to reflect the amount of the current corresponding to the dimmer setting. The sensor output signal is provided to an input of the differential amplifier 208 that generates a transistor control signal that controls the transistor 210.

In some example embodiments, the lighting device 102 includes a voltage regulator 218 that is electrically coupled to the LED driver 104 via the input connection 220. The voltage regulator 218 can generate a regulator output signal that is used to provide a reference signal having a reference voltage to an input of the differential amplifier 208. For example, the lighting device 102 may include a potentiometer 214 or another adjustable resistance component that is coupled between the regulator 218 and the input of the differential amplifier 208. The reference voltage may be adjusted by changing the setting of the potentiometer 214. The reference signal is provided to the differential amplifier 208 via an electrical connection 224 that is coupled to an input of the differential amplifier 208.

The differential amplifier 208 generates the transistor control signal based on the sensor output signal provided via the connection 222 and the reference signal provided via the connection 224. The differential amplifier 208 provide the transistor control signal to the transistor 210 via an electrical connection 226.

During adjustment of the dimmer 106 to reduce the brightness level of the illumination light emitted by the light source 108, the differential amplifier 208 can start turning on transistor 210 when the amount of the current provided to the light source 108 crosses a threshold current value corresponding to the reference voltage of the reference signal provided to the differential amplifier 208. To illustrate, when the dimmer 106 is adjusted to dim the illumination light, the amount of current provided to the light source 108 by the driver 104 is correspondingly reduced. The voltage level of the sensor output signal from the current sensor 212 changes to reflect the reduced current amount from the driver 104.

When the voltage level of the sensor output signal is reduced and crosses the reference voltage of the reference signal, the differential amplifier 208 starts turning the transistor 210 on such that a portion of the current provided to the light source 108 is steered through the second group of LEDs 206 instead of through the first group of LEDs 204. The amount of current steered through the second group of LEDs 206 depends on the difference between the voltage of the sensor output signal and the reference voltage of the reference signal provided to the differential amplifier 208.

As the voltage level of the sensor output signal is reduced further due to dimming, more of the current provided to the light source 108 is steered through the second group of LEDs 206. As the current flowing through the second group of LEDs 206 increases, the contribution of the second (warmer) light from the second group of LEDs 206 to the illumination light increases, and the contribution of the first (cooler) light from the first group of LEDs 204 decreases. When the transistor 210 is fully switched on by the differential amplifier 208, the entire current provided to light source 108 may be steered through the second group of LEDs 206, thus turning off the first light from the first group of LEDs 204.

During adjustment of the dimmer 106 to increase the brightness level of the illumination light emitted by the light source 108, the differential amplifier 208 may turn off the transistor 210 when the current provided to the light source 108 increases and crosses the threshold current corresponding to the reference voltage of the reference signal provided to the differential amplifier 208. When the current provided to the light source 108 is above the threshold, the second group of LEDs 206 is turned off, and the CCT of the illumination matches the CCT of the first (cooler) light from the first group of LEDs 204.

The threshold brightness level of the illumination light from the lighting device 102 at which the differential amplifier 208 starts turns off or switching on the transistor 210 may be changed by adjusting the potentiometer 214 to change the reference voltage of the reference signal provided to the differential amplifier 208. By adjusting the potentiometer 214, the brightness level of the illumination light at which the illumination light starts turning warmer may be changed.

Because of the adjustability of the threshold brightness level corresponding to a threshold amount of the current provided to the light source 108, variations in output currents of LED drivers of different light fixtures may be managed by individually adjusting the reference voltage of the lighting device of individual lighting fixtures. Variations in LEDs and other components of different lighting fixtures may also be managed in a similar manner.

In some example embodiments, the voltage source driver may be used instead of a current source driver 104 without departing from the scope of this disclosure. For example, current may be provided to the light source 108 by converting the voltage from a driver to a current. Although the transistor 210 is shown as a MOSFET, in alternative embodiments, the transistor 210 may be another type of transistor without departing from the scope of this disclosure. In some example embodiments, the adjustment of the potentiometer 214 or another corresponding components may be performed remotely via a wired or wireless communication and/or digital or analog interface.

Figure 3:
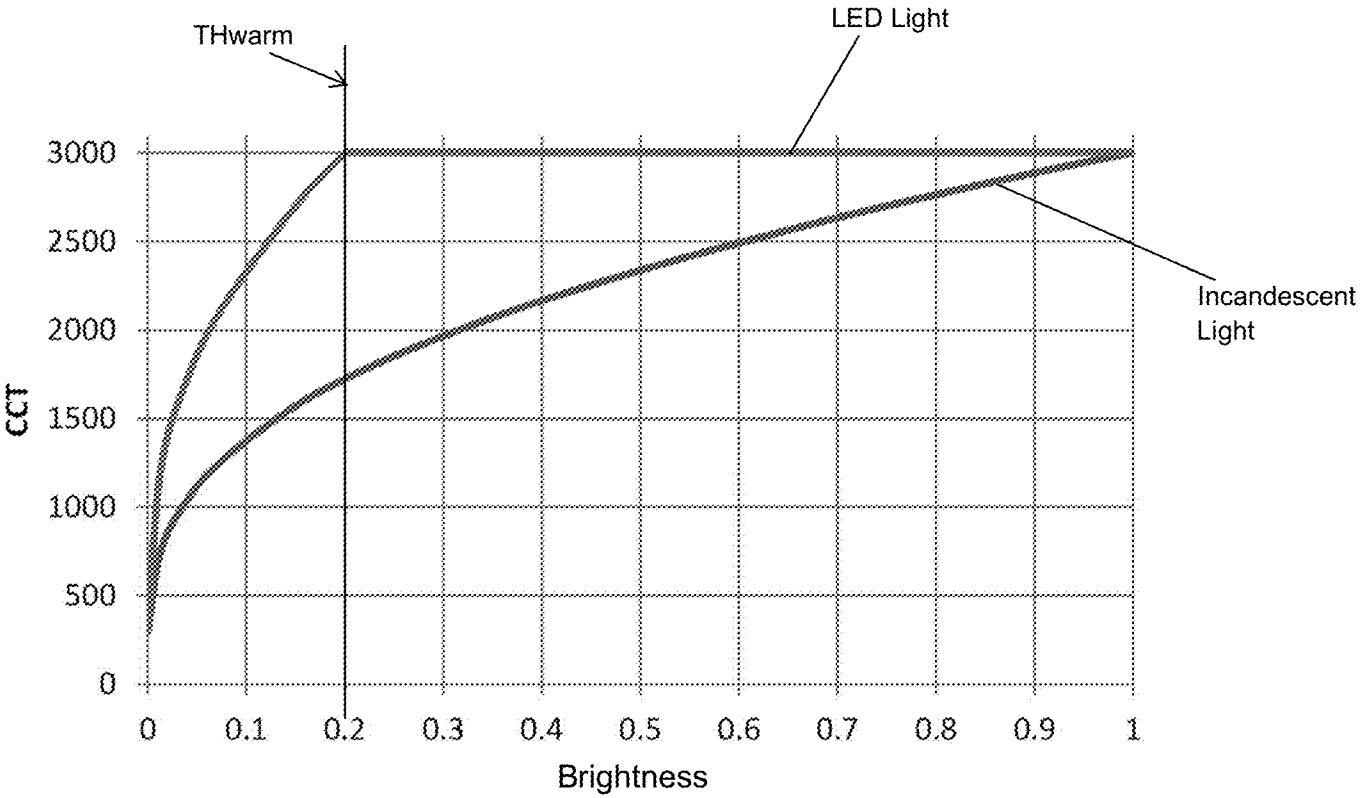
FIG. 3 illustrates plots of CCT vs brightness level for incandescent light and the illumination light emitted by the lighting device of FIG. 1 according to an example embodiment.

FIG. 3 illustrates plots of CCT vs brightness level for incandescent light and the illumination light emitted by the lighting device 102 of FIG. 1 according to an example embodiment. Referring to FIGS. 1-3, the potentiometer 214 may be set to correspond to the threshold brightness level, THwarm, shown on FIG. 3. For example, the threshold brightness level, THwarm, may be set at 20% of full brightness of the illumination light from the light source 108 as shown in FIG. 3. Thus, for brightness level of the illumination light above the threshold brightness level, THwarm, the CCT of the illumination light remains generally constant at approximately 3000 K.

The illumination light starts turning warmer as the brightness of the illumination light is reduced (i.e., as the illumination light is dimmed) crossing the threshold brightness level, THwarm, because of the introduction of the warmer light from the second group of LEDs 206. As shown in FIG. 3, the CCT of the illumination light decreases as the brightness of the illumination light decreases leftward from the threshold brightness level, THwarm, while the CCT of the illumination light remains generally constant to the right of the threshold brightness level despite the increase in brightness level of the illumination light. As explained above, the warm light from the second group of LEDs 206 is off above the threshold brightness level, THwarm, which corresponds to the reference level of the reference signal provided to the differential amplifier 208.

The threshold brightness level, THwarm, may be increased or decreased by adjusting the potentiometer 214 to change the reference voltage of the reference signal provided to the differential amplifier 208. Because the brightness level of the illumination light from the light source 108 corresponds to the amount of current provided to the light source 108 by the driver 104, the CCT of the illumination light may be changed when the setting of the dimmer 106 is changed. By adjusting the potentiometer 214, the threshold brightness level, THwarm, may be decreased below or increased above the 20% value shown in FIG. 3. For example, the threshold brightness level, THwarm, may be increased such that the curve of the illumination light more closely resembles the dimming curve of the incandescent light shown in FIG. 3.

Figure 4:
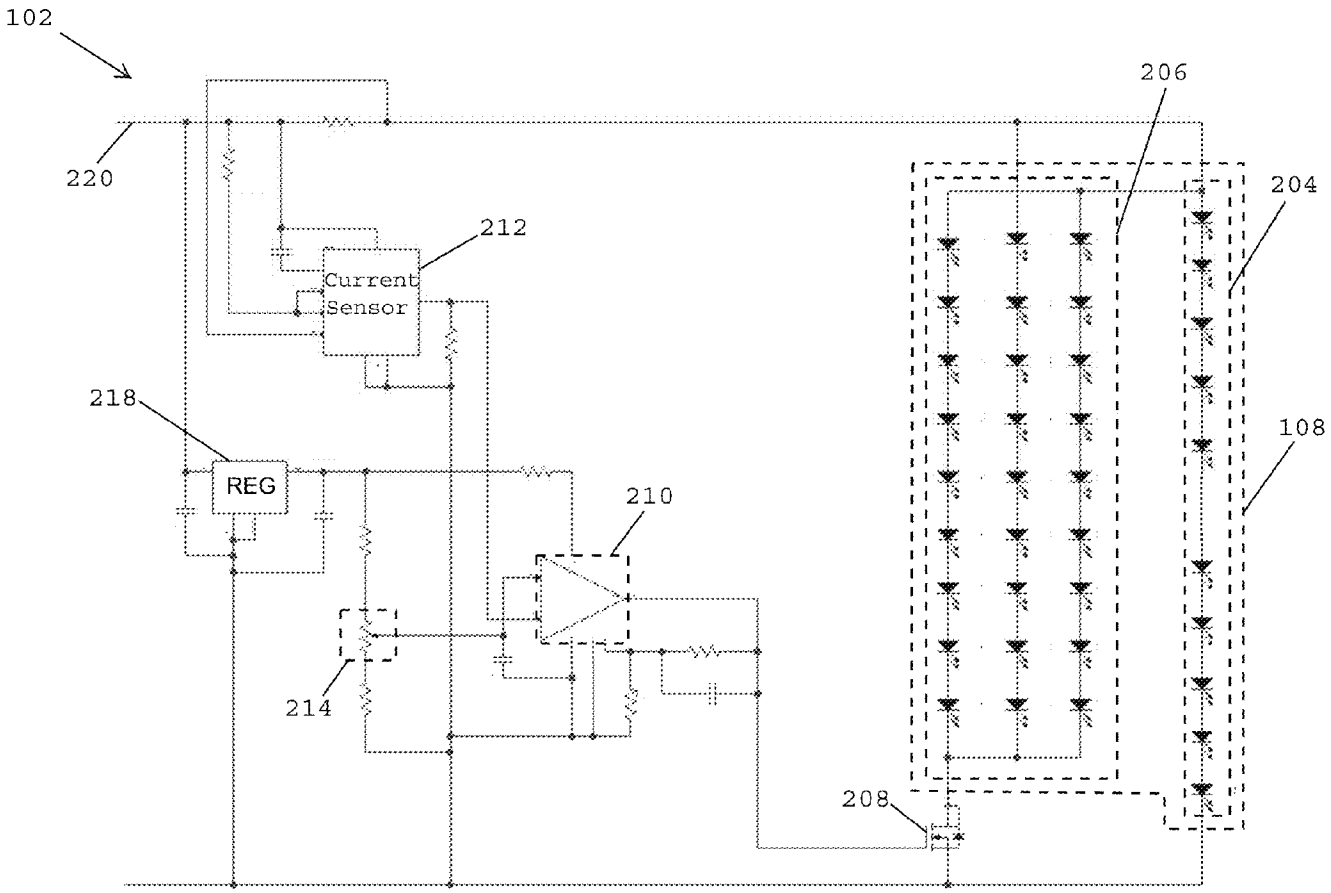
FIG. 4 is a schematic diagram of the lighting device of FIG. 2 according to an example embodiment.

FIG. 4 is a schematic diagram of the lighting device 102 of FIG. 2 according to an example embodiment. Referring to FIGS. 1-4, in some example embodiments, the second light source 206 may include a mix of red and amber LEDs that make the illumination light from the light source 108 warmer when the transistor 210 is conducting current.

In some example embodiments, the differential amplifier 210 may be an instrumentation amplifier. For example, the differential amplifier 210 may be a zero-offset, rail-to-rail differential amplifier. The current sensor 212 may be a high side, high precision current sensor that can respond to small changes in the current provided to the light source 108. The voltage regulator 218 may have relatively low accuracy because of the adjustability of the reference voltage provided to the differential amplifier by changing the potentiometer 214. For example, the regulator output signal may have a voltage of 5V+/−5% based on 20-30V across the first group of LEDs 204 and/or the second group of LEDs 206.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A lighting device, comprising:

a light source that emits an illumination light, the light source comprising a first group of light emitting diodes (LEDs) that emits a first light and a second group of LEDs that emits a second light, wherein the first light has a first Correlated Color Temperature (CCT) and wherein the second light causes the illumination light to have a warmer CCT;

a differential amplifier to adjust a current flow through the second group of LEDs, wherein a reference signal having an adjustable voltage is provided to a first input of the differential amplifier and wherein the second light is switched on when a current provided to the light source is below a threshold corresponding to the adjustable reference voltage; and a current sensor to provide a sensor output signal to a second input of the differential amplifier, the sensor output signal having a second voltage corresponding to the current provided to the light source.

2. The lighting device of claim 1, further comprising a regulator that generates a regulator output signal used to provide the reference signal to the first input of the differential amplifier.

3. The lighting device of claim 2, further comprising a potentiometer electrically coupled between the regulator and the differential amplifier, wherein the adjustable voltage is adjustable by adjusting the potentiometer.

4. The lighting device of claim 1, further comprising a transistor coupled in series with the second group of LEDs, wherein an output of the differential amplifier is electrically coupled to the transistor.

5. The lighting device of claim 4, wherein the differential amplifier adjusts the current flow through the second group of LEDs by controlling the transistor based on the reference signal and the sensor output signal and wherein adjusting the current flow through the second group of LEDs changes proportions of the current provided to the light source that are allocated to the first group of LEDs and the second group of LEDs.

6. The lighting device of claim 4, wherein the differential amplifier starts switching on the transistor when the current provided to the light source drops to below the threshold.

7. The lighting device of claim 1, wherein a forward voltage across the first group of LEDs that is required for the first group of LEDs to emit the first light is higher than a forward voltage across the second group of LEDs that is required for the second group of LEDs 106 to emit the second light.

8. The lighting device of claim 7, wherein the forward voltage across the first group of LEDs is higher than the forward voltage across the second group of LEDs by at least a forward voltage of a single LED.

9. The lighting device of claim 1, wherein the first CCT is in the range of 3000 K to 5000 K and wherein the second light has a CCT in the range of 1000 K to 2700 K.

10. The lighting device of claim 1, wherein the first CCT is approximately 3000 K and wherein the second light includes a red and amber light.

11. A lighting fixture, comprising:

a light source that emits an illumination light, the light source comprising a first group of light emitting diodes (LEDs) that emits a first light and a second group of LEDs that emits a second light, wherein the first light has a first Correlated Color Temperature (CCT) and wherein the second light causes the illumination light to have a warmer CCT;

a differential amplifier to adjust a current flow through the second group of LEDs, wherein a reference signal having an adjustable voltage is provided to a first input of the differential amplifier and wherein the second light is switched on when a current provided to the light source is below a threshold corresponding to the adjustable reference voltage; and a current sensor to provide a sensor output signal to a second input of the differential amplifier, the sensor output signal having a second voltage corresponding to the current provided to the light source; and an LED driver that provides the current to the light source, wherein the LED driver adjusts the current based on light dim level input.

12. The lighting fixture of claim 11, further comprising a regulator coupled to the LED driver that generates a regulator output signal used to provide the reference signal to the first input of the differential amplifier.

13. The lighting fixture of claim 12, further comprising a potentiometer electrically coupled between the regulator and the differential amplifier, wherein the adjustable voltage is adjustable by adjusting the potentiometer.

14. The lighting fixture of claim 11, further comprising a transistor coupled in series with the second group of LEDs, wherein the differential amplifier adjusts the current flow through the second group of LEDs by controlling the transistor based on the reference signal and the sensor output signal.

15. The lighting fixture of claim 11, wherein a forward voltage across the first group of LEDs that is required for the first group of LEDs to emit the first light is higher than a forward voltage across the second group of LEDs that is required for the second group of LEDs to emit the second light.

16. A lighting system, comprising:

a lighting device comprising:

a light source that emits an illumination light, the light source comprising a first group of light emitting diodes (LEDs) that emits a first light and a second group of LEDs that emits a second light, wherein the first light has a first Correlated Color Temperature (CCT) and wherein the second light causes the illumination light to have a warmer CCT;

a differential amplifier to adjust a current flow through the second group of LEDs, wherein a reference signal having an adjustable voltage is provided to a first input of the differential amplifier and wherein the second light is switched on when a current provided to the light source is below a threshold corresponding to the adjustable reference voltage; and a current sensor to provide a sensor output signal to a second input of the differential amplifier, the sensor output signal having a second voltage corresponding to the current provided to the light source;

an LED driver that provides the current to the light source; and a dimmer communicably coupled to the LED driver, wherein the LED driver adjusts the current provided to the light source based on a light dim level input from the dimmer.

17. The lighting system of claim 16, further comprising a regulator coupled to the LED driver that generates a regulator output signal used to provide the reference signal to the first input of the differential amplifier.

18. The lighting system of claim 17, further comprising a potentiometer electrically coupled between the regulator and the differential amplifier, wherein the adjustable voltage is adjustable by adjusting the potentiometer.

19. The lighting system of claim 16, further comprising a transistor coupled in series with the second group of LEDs, wherein the differential amplifier adjusts the current flow through the second group of LEDs by controlling the transistor based on the reference signal and the sensor output signal.

20. The lighting system of claim 16, wherein a forward voltage across the first group of LEDs that is required for the first group of LEDs to emit the first light is higher than a forward voltage across the second group of LEDs that is required for the second group of LEDs to emit the second light.

* * * * *